US010377542B2

(12) United States Patent
Lee et al.

(10) Patent No.: US 10,377,542 B2
(45) Date of Patent: Aug. 13, 2019

(54) HEAT-RESISTANT RECEPTACLE CAP

(71) Applicants: KJ TECHNOLOGY CO., LTD., Seo-gu, Incheon (KR); JCTECH CO., LTD, Incheon (KR)

(72) Inventors: Young Jae Lee, Seoul (KR); Ji Sun Lee, Gyeonggi-do (KR); Ho Jae Lee, Gyeonggi-do (KR)

(73) Assignees: KJ TECHNOLOGY CO., LTD. (KR); JCTECH CO., LTD. (KR)

( * ) Notice: Subject to any disclaimer, the term of this patent is extended or adjusted under 35 U.S.C. 154(b) by 44 days.

(21) Appl. No.: 15/374,797

(22) Filed: Dec. 9, 2016

(65) Prior Publication Data

US 2018/0118427 A1 May 3, 2018

(30) Foreign Application Priority Data

Nov. 3, 2016 (KR) ..... 10-2016-0145588

(51) Int. Cl.
*B65D 25/08* (2006.01)
*B65D 81/32* (2006.01)
(Continued)

(52) U.S. Cl.
CPC ..... *B65D 51/28* (2013.01); *B65D 39/0052* (2013.01); *B65D 41/3428* (2013.01);
(Continued)

(58) Field of Classification Search
CPC ..... A45F 3/16; A47J 43/27; B01F 11/0011; B01F 11/0005; B65D 39/0052; B65D 41/3428; B65D 45/322; B65D 51/28; B65D 51/18; B65D 51/2807; B65D 53/04; B65D 81/3216; B65D 81/3222; B65D 81/3282; B65D 2251/0015; B65D 2251/0062;
(Continued)

(56) References Cited

U.S. PATENT DOCUMENTS 1,609,447 A * 12/1926 Ward ..... B65D 51/28 215/6
1,651,023 A * 11/1927 Hanna ..... B65D 51/245 215/227
(Continued)

*Primary Examiner* — Gideon R Weinerth
(74) *Attorney, Agent, or Firm* — Sheridan Ross P.C.

(57) ABSTRACT

The present invention is a heat-resistant receptacle cap comprising: an inner cap 100 having an insertion pipe 120 configured to be fitted onto an inlet of a receptacle with a locking hook, a discharge gate 140 connected to the insertion pipe 120 with a small-diameter pipe 145 and formed so that contents in the receptacle is discharged at the small-diameter pipe 145, and a container 200 which is installed at the bottom of the small-diameter pipe 145 and has an open upper part to hold additives therein;

a heat-resistant sealing plate 220 configured to heat-seal the insertion pipe 120 and upper wall of the container 200;

a sealing plate holder 300 which is provided with a fitting ring 310 that fits the sealing plate 220 to a corresponding part for coupling the heat-resistant sealing plate 220, and which is fitted at an upper end of an inner side wall of an outer cap 400; and the outer cap 400 having a sealing plate holder fixing step 420 which is formed on a side wall 401 and configured to separate the sealing plate holder 300 as the receptacle is opened.

2 Claims, 11 Drawing Sheets

(51) Int. Cl.

| | |
|---|---|
| ***B65D 51/28*** | (2006.01) |
| ***B65D 39/00*** | (2006.01) |
| ***B65D 45/32*** | (2006.01) |
| ***B65D 41/34*** | (2006.01) |
| ***B65D 51/18*** | (2006.01) |
| ***B65D 53/04*** | (2006.01) |

(52) U.S. Cl.
CPC ..... *B65D 45/322* (2013.01); *B65D 51/18* (2013.01); *B65D 53/04* (2013.01); *B65D 2251/009* (2013.01); *B65D 2251/0015* (2013.01); *B65D 2251/0062* (2013.01); *B65D 2539/006* (2013.01)

(58) Field of Classification Search
CPC ..... B65D 2251/009; B65D 2539/006; B65D 51/2864; B65D 51/2857; Y10S 215/08; B65B 61/20; B65B 29/10
USPC ..... 215/227, 6; 220/521, 522; 206/219, 221, 206/222; 366/130
See application file for complete search history.

(56) References Cited

U.S. PATENT DOCUMENTS 2,829,807 A * 4/1958 Kirschenbaum ..... B65D 47/123 222/421
3,132,777 A * 5/1964 Hebert ..... B65D 51/28 141/381
3,693,847 A * 9/1972 Gibson ..... B65D 47/122 215/DIG. 1
4,416,382 A * 11/1983 Lawrence ..... B65D 85/84 215/231
4,756,436 A * 7/1988 Morita ..... B65D 51/244 215/228
5,105,961 A * 4/1992 Noren ..... B65D 41/086 215/211
5,114,011 A * 5/1992 Robbins, III ..... B29C 53/08 206/219
5,318,183 A * 6/1994 Cohen ..... B65D 77/0493 206/528
5,392,939 A * 2/1995 Hidding ..... B67D 3/0032 141/348
5,749,460 A * 5/1998 Rice ..... B65D 81/3216 215/10
5,806,707 A * 9/1998 Boehm ..... B65D 51/28 206/217
5,813,563 A * 9/1998 Boehm ..... B65D 51/28 206/217
5,915,585 A * 6/1999 Ladina ..... B65D 51/28 206/217
5,984,141 A * 11/1999 Gibler ..... A47J 41/0027 206/219
6,059,443 A * 5/2000 Casey ..... A45F 3/16 206/219
6,085,927 A * 7/2000 Kusz ..... B65D 77/0493 215/6
6,352,153 B1 * 3/2002 Ohashi ..... B65D 51/26 206/205
7,175,037 B2 * 2/2007 Deir ..... B65D 77/0493 206/519
7,537,112 B2 * 5/2009 Balazik ..... B65D 51/28 206/219
7,588,142 B1 * 9/2009 Bush ..... B65D 51/2857 206/221
8,298,174 B2 * 10/2012 Showers ..... A61J 7/0061 215/211
9,004,302 B2 * 4/2015 Ginzburg ..... B65D 51/227 206/0.5
9,090,395 B2 * 7/2015 Koumans ..... B65D 81/3216
9,242,783 B2 * 1/2016 Cho ..... B65D 51/2892
9,718,599 B2 * 8/2017 Casey ..... B65D 81/3216
2003/0029827 A1 * 2/2003 Renz ..... A61J 9/00 215/11.1
2005/0040052 A1 * 2/2005 Dixon ..... B65D 51/28 206/217
2005/0184025 A1 * 8/2005 Hurley ..... B65D 51/244 215/227
2008/0202950 A1 * 8/2008 Anderson ..... B65D 51/2842 206/219
2012/0152770 A1 * 6/2012 Dreyer ..... B65D 51/2892 206/221
2013/0112646 A1 * 5/2013 Cho ..... B65D 51/28 215/227
2013/0186779 A1 * 7/2013 Kambouris ..... B65D 51/28 206/222
2016/0198903 A1 * 7/2016 Casey ..... A47J 43/27 366/130
2016/0199801 A1 * 7/2016 Casey ..... B01F 15/0224 366/130
2016/0304264 A1 * 10/2016 Steinberg ..... B65D 45/025
2017/0291751 A1 * 10/2017 Roh ..... B65D 81/32
2017/0327295 A1 * 11/2017 Casey ..... B65D 81/3222
2018/0118427 A1 * 5/2018 Lee ..... B65D 51/28

* cited by examiner

HEAT-RESISTANT RECEPTACLE CAP

CROSS-REFERENCE TO RELATED APPLICATIONS

This application claims the benefit of Korean Patent Application No. 10-2016-0145588 filed Nov. 3, 2016, the entire contents of which are incorporated herein by reference in its entirety.

TECHNICAL FIELD

The present invention relates to a heat-resistant receptacle cap.

BACKGROUND OF ART

A receptacle cap, which is generally used to immediately add additives to contents in a receptacle when the receptacle cap is opened, so even additives that spoil easily may be stored in a fresh state and then added right to the receptacle contents before drinking, has been developed as Korean granted utility model no. 20-0360704.

Further, receptacle caps which hold additives inside and the contents in the receptacle may be drunk together therewith have been developed as Korean granted patent no. 10-1344480, Korean granted patent no. 10-1342876, and Korean granted patent no. 10-1499752. Korean granted patent no. 10-1344480 has a problem of difficulties in long-term storage due to its sealing plate being permeable, and Korean granted patent no. 10-1342876 does its sealing using an aluminum seal, so the permeability problem is modified, but because a separate assembly device needs to be added, there are problems of having poor assembling properties and being fragile to external impact. Also, Korean granted patent no. 10-1499752 is easy to assemble and use, but it is difficult to put in contents that require sterilization at 70 to 80 degrees Celsius because of its low heat resistance.

DISCLOSURE OF THE INVENTION

Technical Problem

For resolving the aforesaid problems of the prior arts, it is an object of the present invention to provide a heat-resistant receptacle cap to enable production using existing processes without any separate process changes by combining a sealing plate of an aluminum seal kind prior to combining it with a container and to provide heat resistance.

It is another object of the present invention to provide a heat-resistant receptacle cap, wherein a sealing plate of an aluminum seal kind is coupled to a separate sealing plate holder, the sealing plate holder is made to be fitted and fixed to an outer cap so the sealing plate seals and is coupled to a container with induction heating, and when the heat-resistant receptacle cap is opened, the sealing plate holder is made so it opens simultaneously with the outer cap, making it easy to use.

Another object of the present invention is to provide a heat-resistant receptacle cap which uses a separate container for containing additives, the inlet of the container heat-sealed with a heat-resistant sealing plate, thereby maintaining performance without any changes in the moisture permeability or the sealing even when expansion and contraction occurs due to temperature changes, to be usable for novel instant warm beverages, for medical use or all natural concentrates, or scented additives such as coffee so that it gives off its just-boiled coffee-like scent in a constant manner.

Technical Solution

In order to accomplish the above present object, the present invention provides a heat-resistant receptacle cap comprising:

- an inner cap having an insertion pipe configured to be fitted onto an inlet of a receptacle with a locking hook, a discharge gate connected to the insertion pipe with a small-diameter pipe and formed so that contents in the receptacle is discharged at the small-diameter pipe, and a container which is installed at the bottom of the small-diameter pipe and has an open upper part to hold additives therein;
- a heat-resistant sealing plate configured to heat-seal the insertion pipe and upper wall of the container;
- a sealing plate holder which is provided with a fitting ring that fits the sealing plate to a corresponding part for coupling the sealing plate, and which is fitted at an upper end of an inner side wall of an outer cap; and
- the outer cap having a sealing plate holder fixing step which is formed on a side wall and configured to separate the sealing plate holder as the receptacle is opened.

The present invention also provides a heat-resistant receptacle cap comprising:

- an inner cap having an insertion pipe configured to be fitted onto an inlet of a receptacle with a locking hook, a discharge gate connected to the insertion pipe with a small-diameter pipe and formed so that contents in the receptacle is discharged at the small-diameter pipe, and a container which is installed at a bottom and has an open upper part to hold additives therein;
- a heat-resistant sealing plate configured to heat-seal the upper wall of the container;
- a fitting ring that fits the heat-resistant sealing plate to a corresponding part for coupling the heat-resistant sealing plate, an outer circumference which is fitted at an upper end of an inner side wall of an outer cap, and a sealing plate holder having a sealing dam protruding downwards to seal the inner circumference part of the insertion pipe; and
- a sealing plate holder fixing step, configured to fit and couple the sealing plate holder and formed on an inner part of the side wall, and the outer cap is configured to separate the sealing plate holder as the receptacle is opened.

Advantageous Effects

According to the present invention, as described above, a heat-resistant receptacle cap which enables production using existing processes without any separate process changes by combining a sealing plate of aluminum seal kind prior to combining it with a container and to provide heat resistance is provided.

The present invention couples a sealing plate of an aluminum seal kind to a separate sealing plate holder, wherein the sealing plate holder is made to be fitted and fixed to an outer cap so the sealing plate seals and is coupled to a container with induction heating, and when the heat-resistant receptacle cap is opened, the sealing plate holder is made so it opens simultaneously with the outer cap, making it easy to use.

The present invention uses a separate container for containing additives, the inlet of the container heat-sealed with a heat-resistant sealing plate, thereby making it possible to maintain performance without any changes in the moisture permeability or the sealing even when expansion and contraction occurs due to temperature changes, to be usable for novel instant warm beverages, for medical use or all natural concentrates, or scented additives such as coffee so that it gives off its just-boiled coffee-like scent in a constant manner.

DETAILED DESCRIPTION OF THE EMBODIMENTS

Hereinafter, preferred embodiments of the present invention will be described in more detail with reference to the accompanying drawings.

Figure 1:
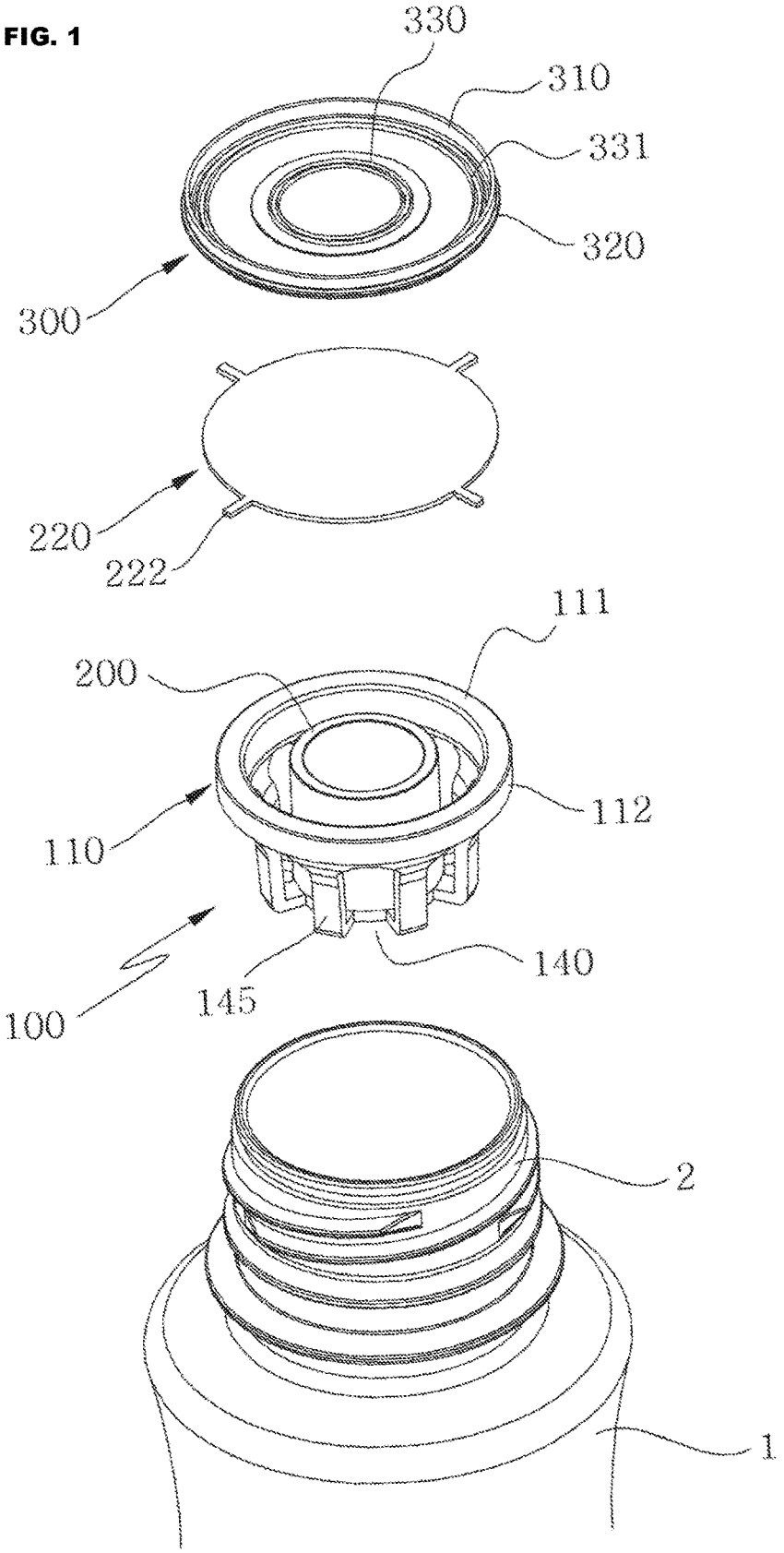
FIG. 1 is an exploded perspective view of the present invention.
Figure 2:
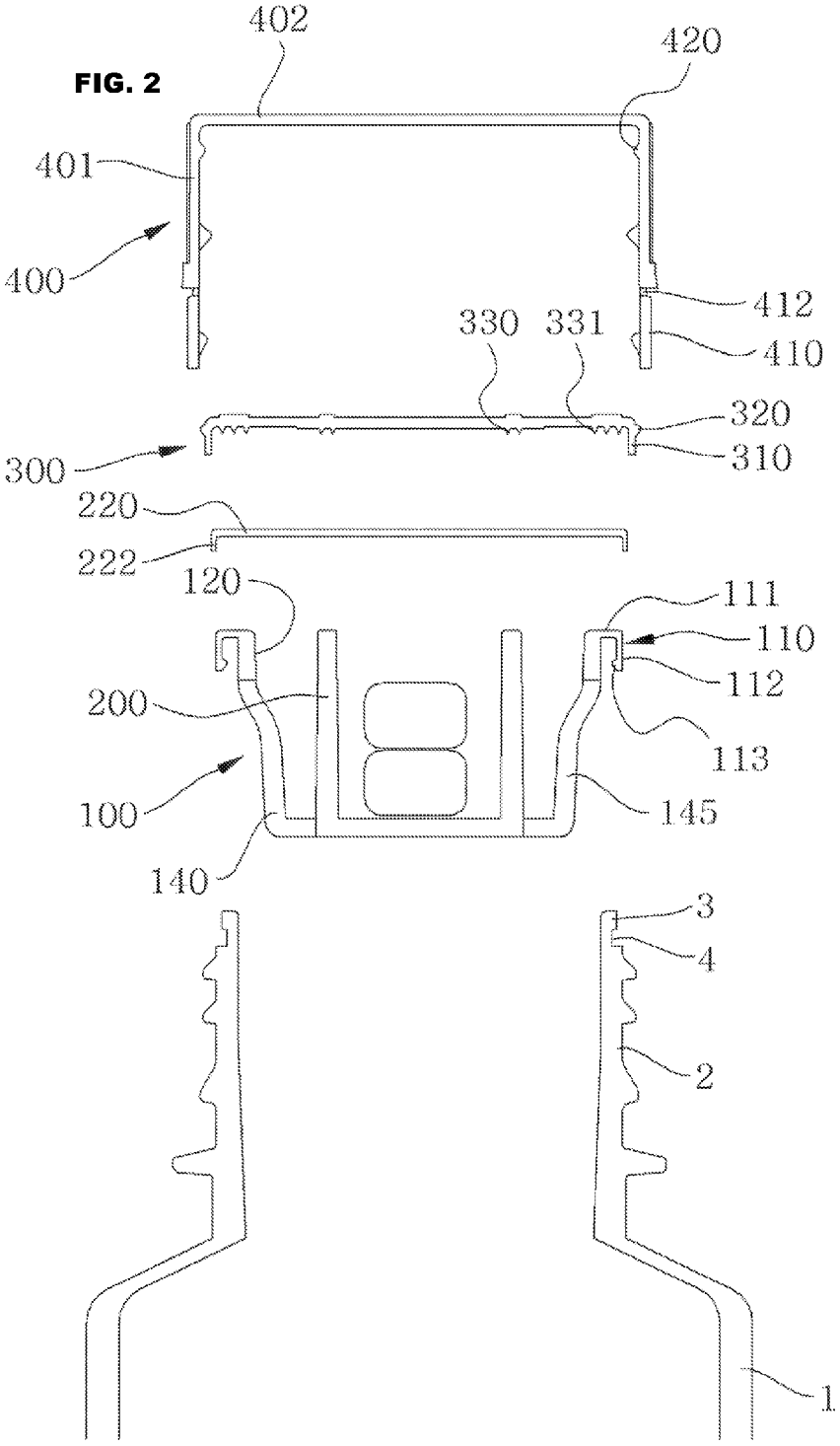
FIG. 2 is an exploded cross-sectional view of the present invention.
Figure 3:
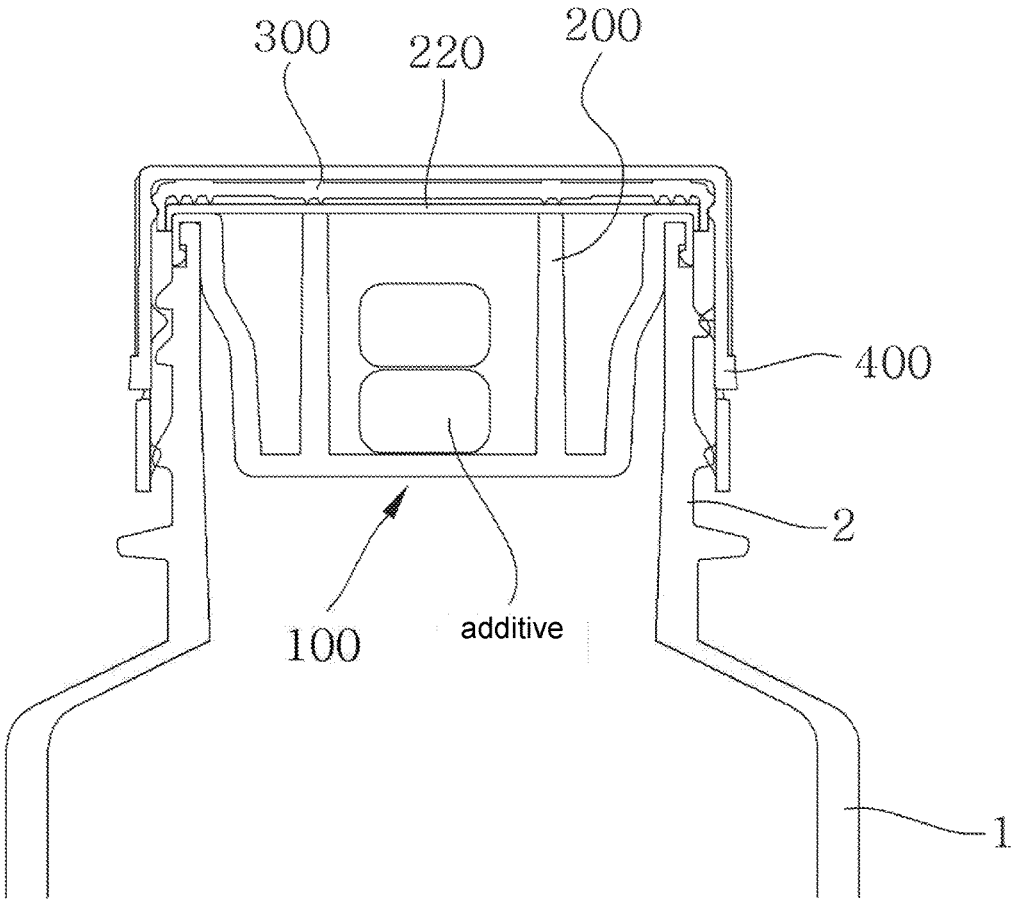
FIG. 3 is a cross-sectional view of the assembled state of FIG. 2.

According to an embodiment of the present invention, as shown in FIGS. 1 to 3, a heat-resistant receptacle cap is configured to comprise: an inner cap 100 having an insertion pipe 120 configured to be fitted onto an inlet 2 of a receptacle 1 with a locking hook, a discharge gate 140 connected to the insertion pipe 120 with a small-diameter pipe 145 and formed so that contents in the receptacle is discharged at the small-diameter pipe 145, and a container 200 which is installed at a bottom of the small-diameter pipe and has an open upper part to hold additives therein;

- a heat-resistant sealing plate 220 configured to heat-seal the insertion pipe 120 and upper wall of the container 200;
- a sealing plate holder 300 which is provided with a fitting ring 310 that fits the heat-resistant sealing plate 220 to a corresponding part for coupling the heat-resistant sealing plate 220, and which is fitted at an upper end of an inner side wall of an outer cap 400; and
- the outer cap 400 having a sealing plate holder fixing step 420 which is formed on a side wall 401 and configured to separate the sealing plate holder 300 as the receptacle is opened. The illustration of the outer cap 400 was omitted in FIG. 1. 330 is a pusher protrusion configured to push to help heat-seal the upper end of the inlet of the container 200 better during induction heat sealing, and 331 is a pusher protrusion configured to push the horizontal part 111.

It is preferable to have the fitting ring 310 formed to have a height that may fix a length of a handle 222 of the sealing plate 220 and a locking hook portion simultaneously.

The locking hook 110 is configured to have a horizontal part 111 bent towards the outside of the insertion pipe 120, and a vertical part 112 which bends downwards from the outside of the horizontal part 111 and forms a hook 113 at a lower end of an inner side thereof; and

- at an upper end outside the inlet 2 of the receptacle 1, an outer groove 4 configured to be coupled to the hook 113 and an outer hook 3 protruding from the upper end of the inlet due to the outer groove 4 is formed. A protruding step 320 is protruded from the outside or lower end of the fitting ring 310, thereby being fitted and fixed by the sealing plate holder fixing step 420, and is a protruding step configured to provide support so that the sealing plate holder 300 is separated together with the separation of the outer cap 400.

The present invention uses the components shown in FIG. 2 to assemble and use an additive as shown in FIG. 3. As an example of the assembly, a receptacle is filled with contents through an inlet 2 of the receptacle 1. Apart from this, an additive is held inside a container 200 of an inner cap 100, and a sealing plate holder 300 has a heat-resistant sealing plate 220 fitted between a fitting ring 310 of the sealing plate holder 300 beforehand so that a part thereof is also fitted and supported at the locking hook 110 of the inner cap 100 to be coupled provisionally. The provisionally coupled sealing plate holder 300, heat-resistant sealing plate 220, and inner cap 100 are coupled to be simultaneously supported by a protruding step 320 of the sealing plate holder 300 past a side wall 401 of the outer cap 400.

In addition, the heat-resistant sealing plate 220 heat-seals the upper end inlet of the container 200 of the inner cap 100 and the horizontal part 111 of the locking hook 110 with induction heating.

Figure 10:
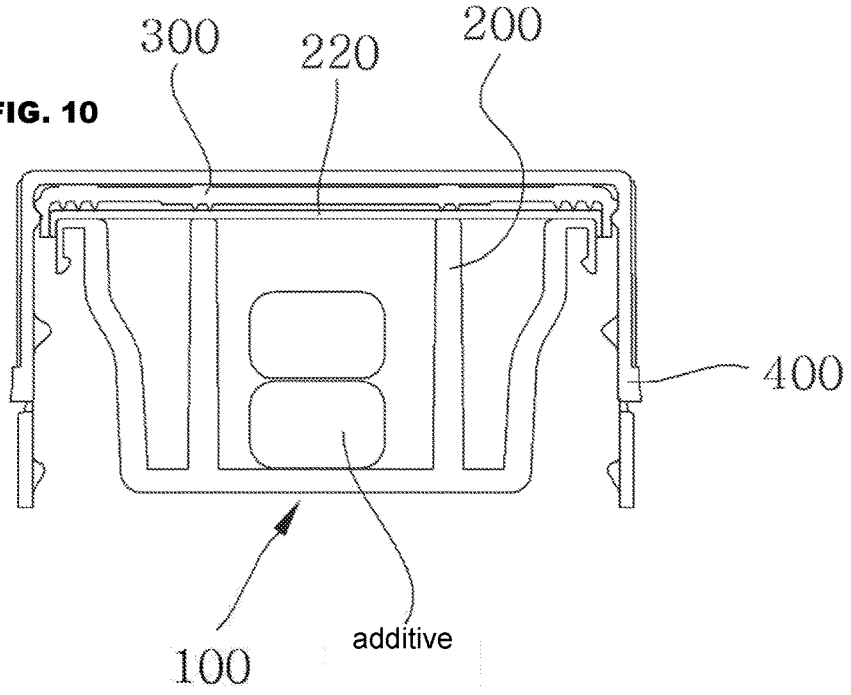
FIG. 10 is a cross-sectional view showing the provisionally coupled state of FIG. 2.
Figure 10:
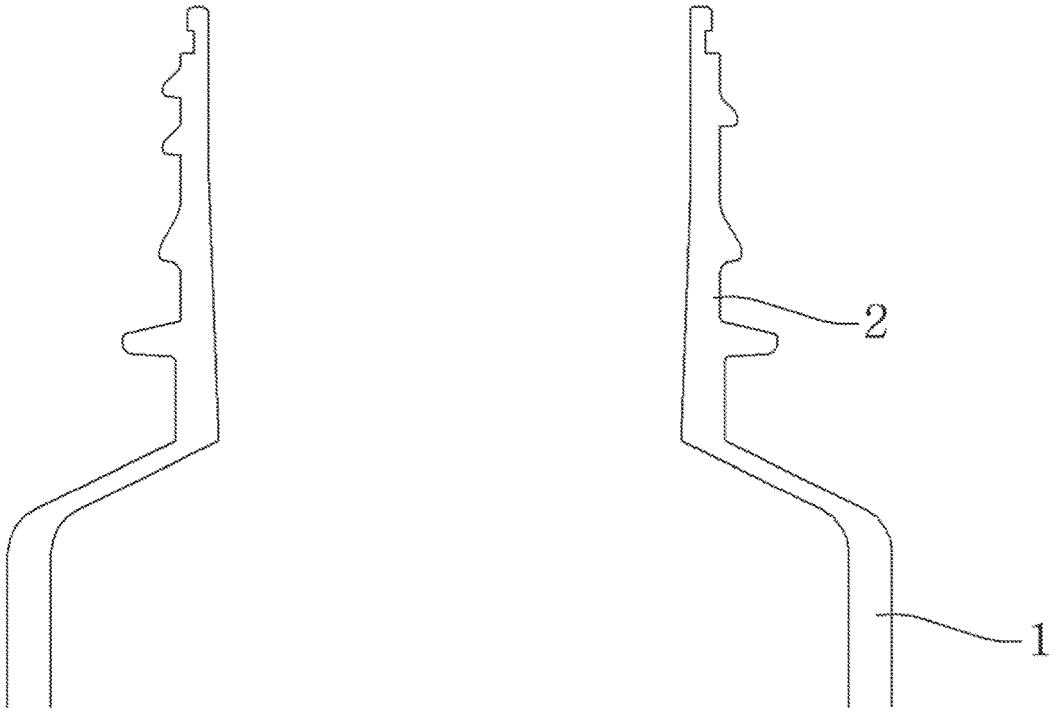

Of course, the sealing plate holder 300, sealing plate 220, and inner cap 100 filled with additives may be induction heat-sealed at a provisionally coupled state to separately assemble a provisionally coupled state as shown in FIG. 10 of a heat-resistant sealing plate 220 already in a state sealed to the inner cap 100, and what was separately assembled may be capped at the inlet 2 of the contents filled receptacle 1 to form a capped state as shown in FIG. 3.

Figure 11:
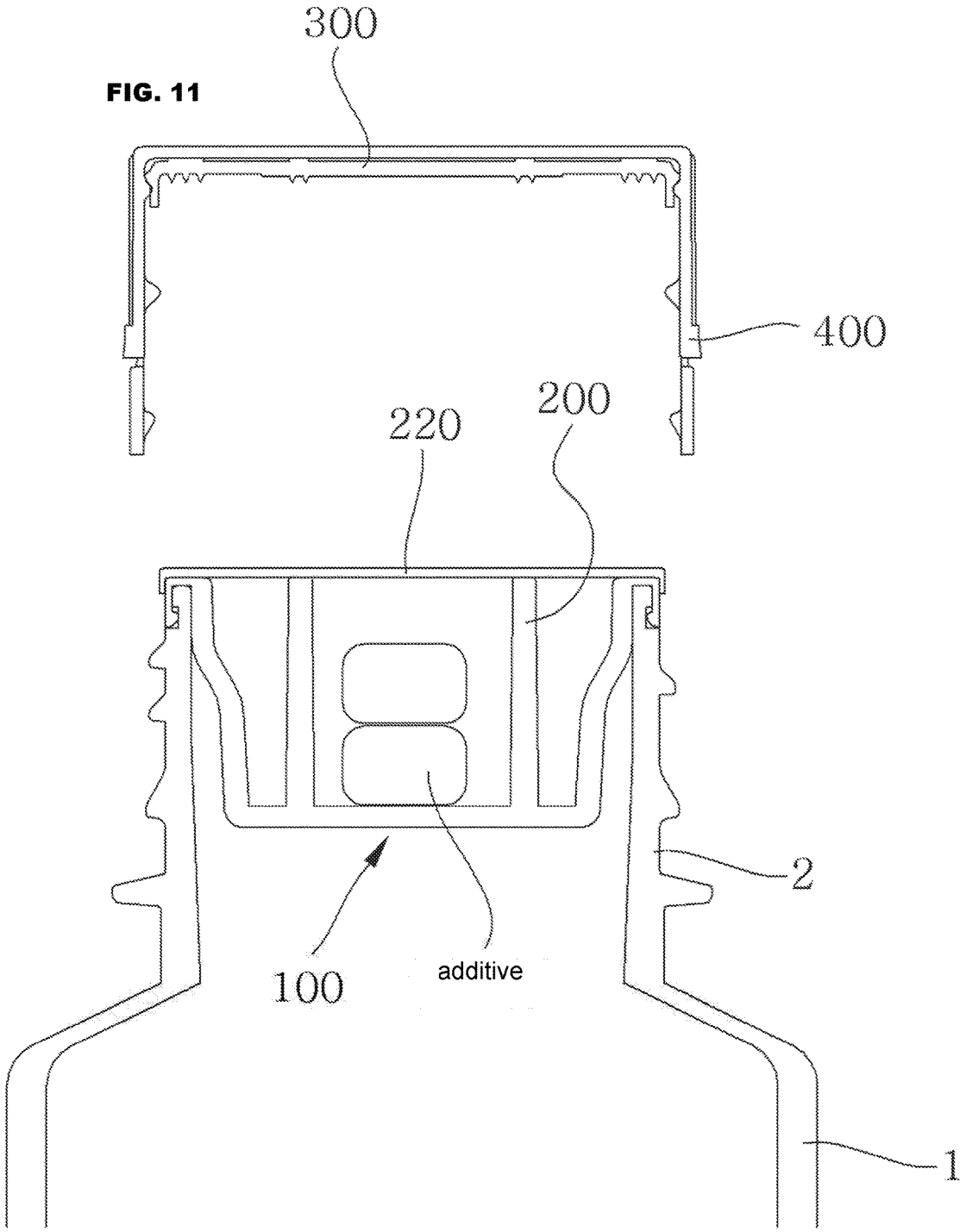
FIG. 11 is a cross-sectional view showing the using state of FIG. 3.

When a user purchases and separates the outer cap 400, the state of the outer cap 400 and sealing plate holder 300 being separated simultaneously from the heat-resistant sealing plate 220 is as formed as shown in FIG. 11. Thus the user may tear the heat-resistant sealing plate 220 and drink the contents in the receptacle together with an additive the same time, and the heat-resistant sealing plate has been found to have a long storage life of over 6 months like that of a typical retort receptacle, thereby allowing storage of coffee or oriental herb concentrates, powder which lasts without its nutrients being lost when blocked from oxygen or a granular nutrient, vitamins or variable granular or power or liquid forms of additives for more than 6 months.

The upper surface of the sealing plate 220 is an aluminum sheet, and a double-layered synthetic resin sheet product is used as the lower surface. When induction heated, the aluminum sheet does not perform any heat sealing so the sealing plate holder 300 is fitted into the outer cap 400 and enabled to be separated from the heat-resistant sealing plate at the same time, and the heat-sealed sealing plate 220 is heat-sealed integrally to the inner cap 100 to perform sealing.

Therefore, the inner cap 100 which holds the additive may maintain its sealing property by the heat-resistant sealing plate 220 and there are no worries of any moisture and smells being permeated, so if beverages that are used as warm drinks such as tea, coffee, or milk hold additional additives separately, it functions to enable use on just-boiled tea or warm drinks that can provide a fresh scent of an additive.

Figure 4:
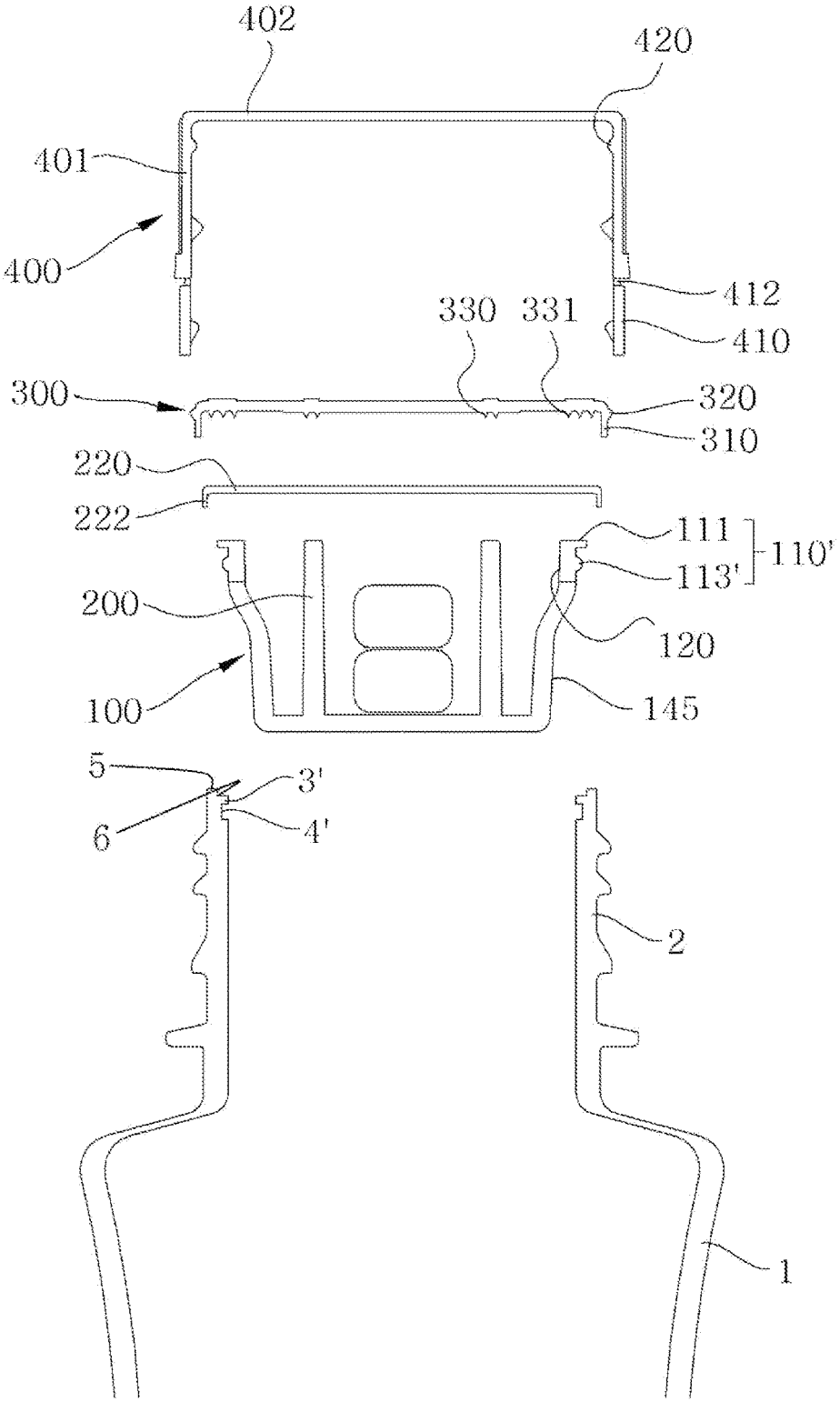
FIG. 4 is an exploded cross-sectional view of another example of the present invention.
Figure 5:
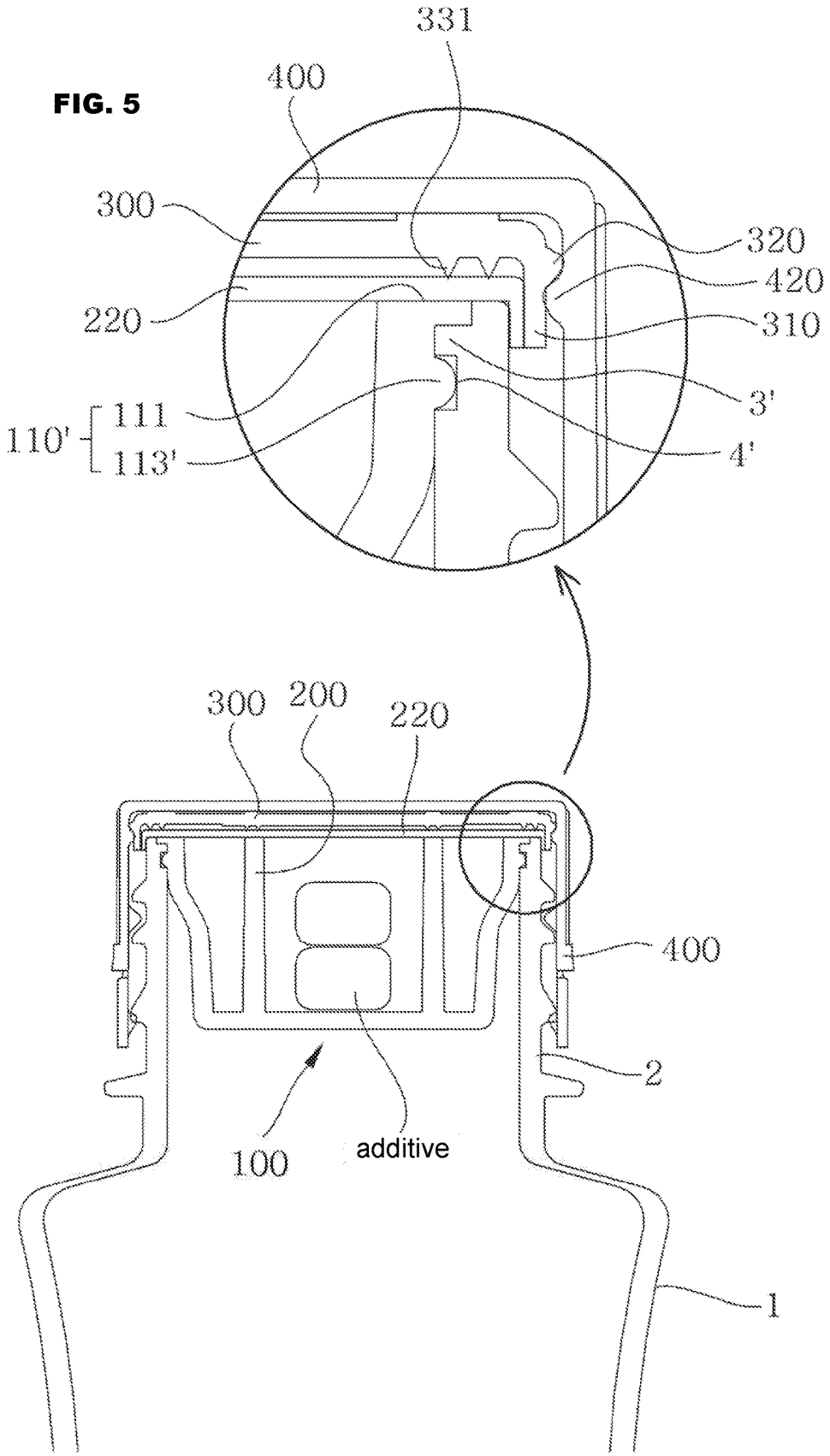
FIG. 5 is a cross-sectional view of the assembled state of FIG. 4.

According to another exemplary embodiment of the present invention, as shown in FIGS. 4 and 5, the sealing plate 220, the sealing plate holder 300 and the outer cap 400 is the same as those of FIGS. 1 to 3, and thus the basic description thereof is omitted.

The difference is that, the locking hook 110' formed at the insertion pipe 120 of the inner cap 100 is configured to have a horizontal part 111 bent towards the outside of the insertion pipe 120, and a hook 113' protruding from an outer circumference part of the insertion pipe 120; and an inner groove 4' configured to be coupled to the hook 113', an inner hook 3' protruding from an upper end of the inlet due to the inner groove 4', and an upper end groove 6 configured to have a surface of the horizontal part 111 be fitted horizontally to an upper end wall 5 at the inner circumference side of the upper end wall 5 of the inlet 2 of the receptacle 1, is comprised to be configured at the upper end inside the inlet 2 of the receptacle 1.

Figure 6:
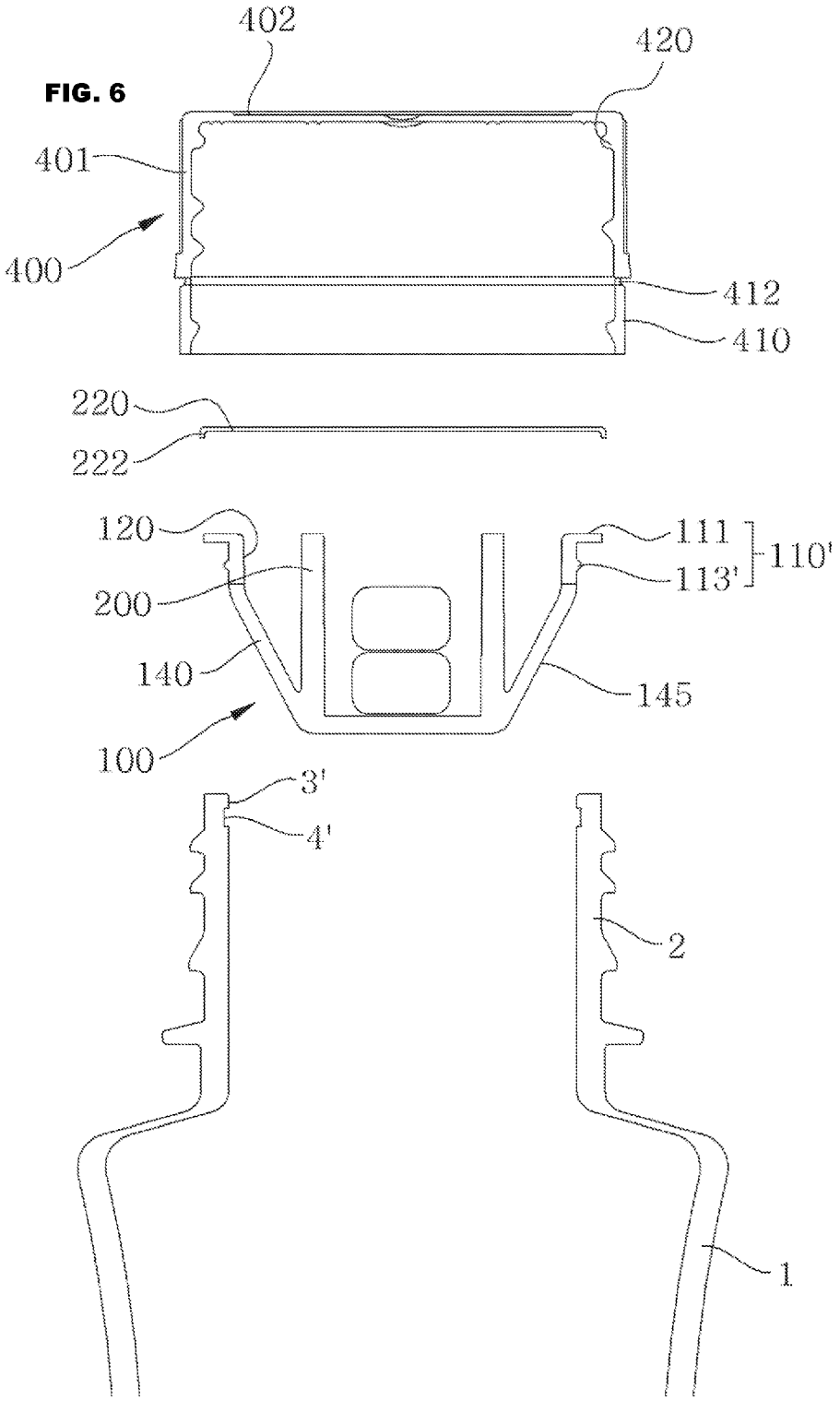
FIG. 6 is an exploded cross-sectional view of another example of the present invention.
Figure 7:
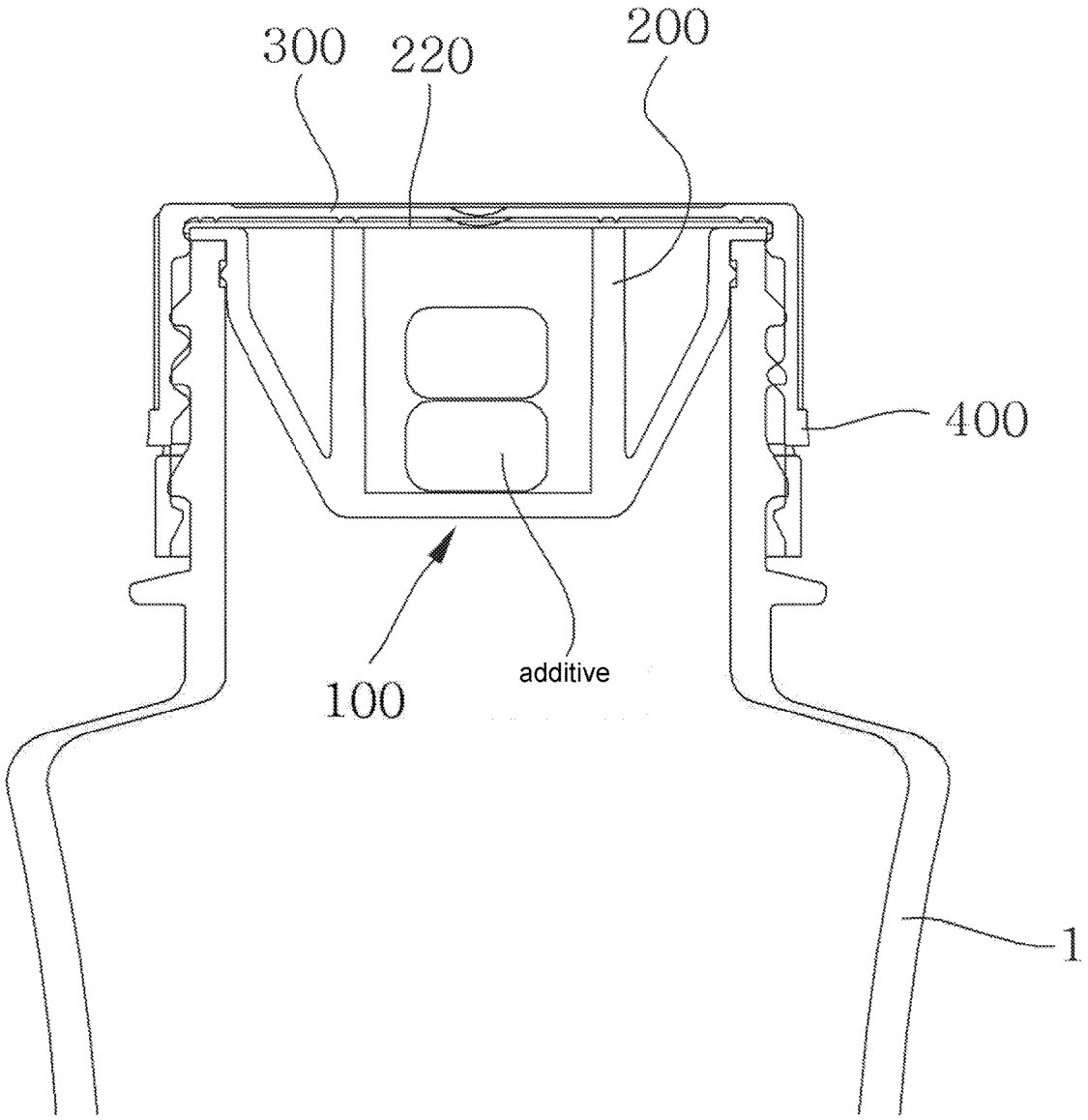
FIG. 7 is a cross-sectional view of the assembled state of FIG. 6.

The sealing plate holder 300 which is coupled to the sealing plate holder fixing step 420 of the outer cap 400 may be integrally formed with the outer cap 400 as shown in FIG. 6 and FIG. 7.

Other than the coupled structure configured to have a locking hook 110' of the inner cap 100 formed with a hook 113' and a horizontal part 111, and a corresponding inner wall of the inlet 2 of the receptacle 1 formed with an inner groove 4' and an inner hook 3', shown in FIGS. 4 to 7, the basic functions are the same as those of FIGS. 1 to 3, and thus the description of coupling and usage principles thereof is omitted.

However, since the sealing plate 220 heat-seals the horizontal part 111 and upper end wall 5 simultaneously, the inner cap 100 and inlet 2 completely seals the contents of the receptacle, thereby maximizing the sealing properties to enable long-term storage for over 6 months.

Figure 8:
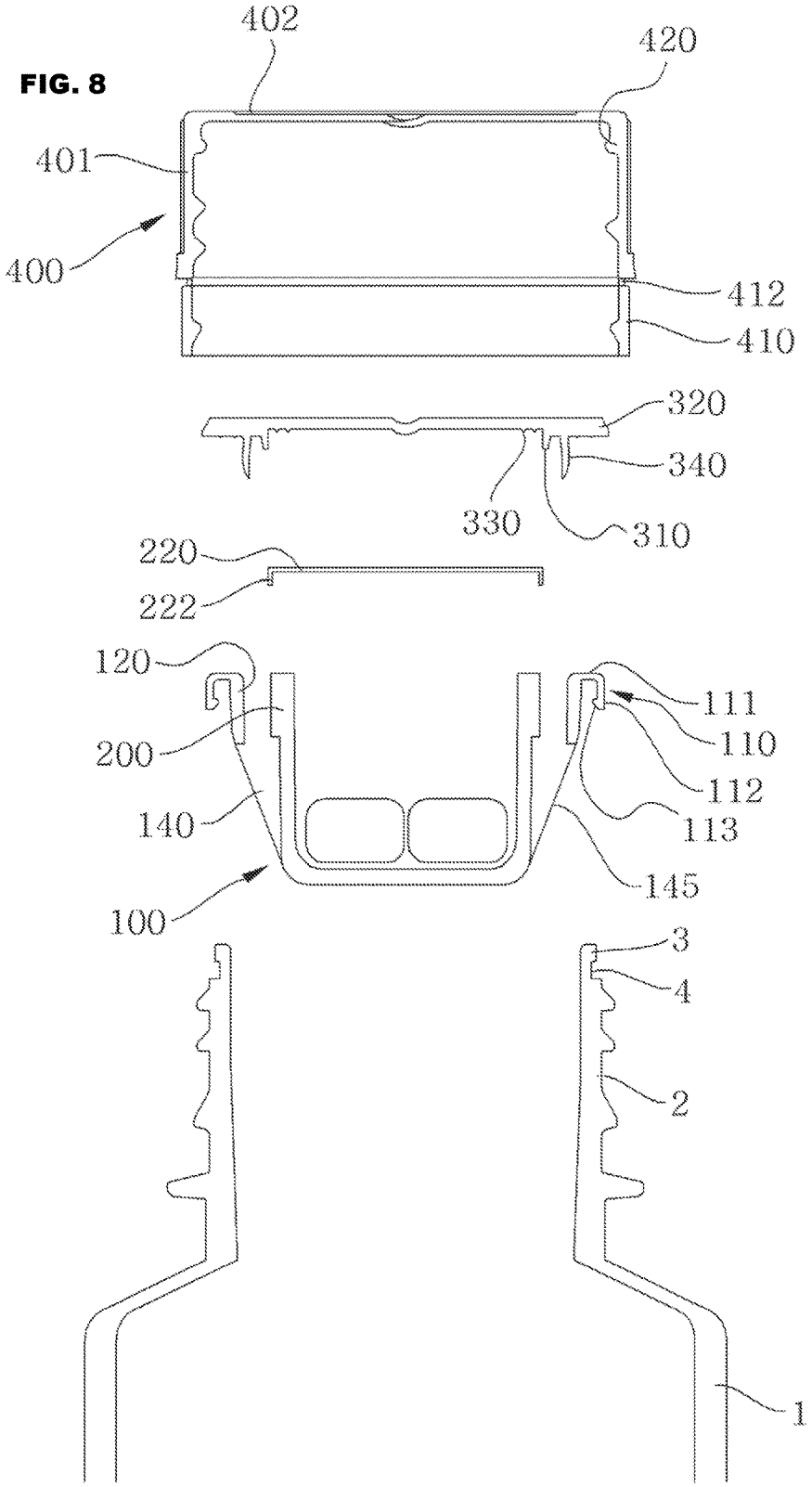
FIG. 8 is an exploded cross-sectional view of another example of the present invention.
Figure 9:
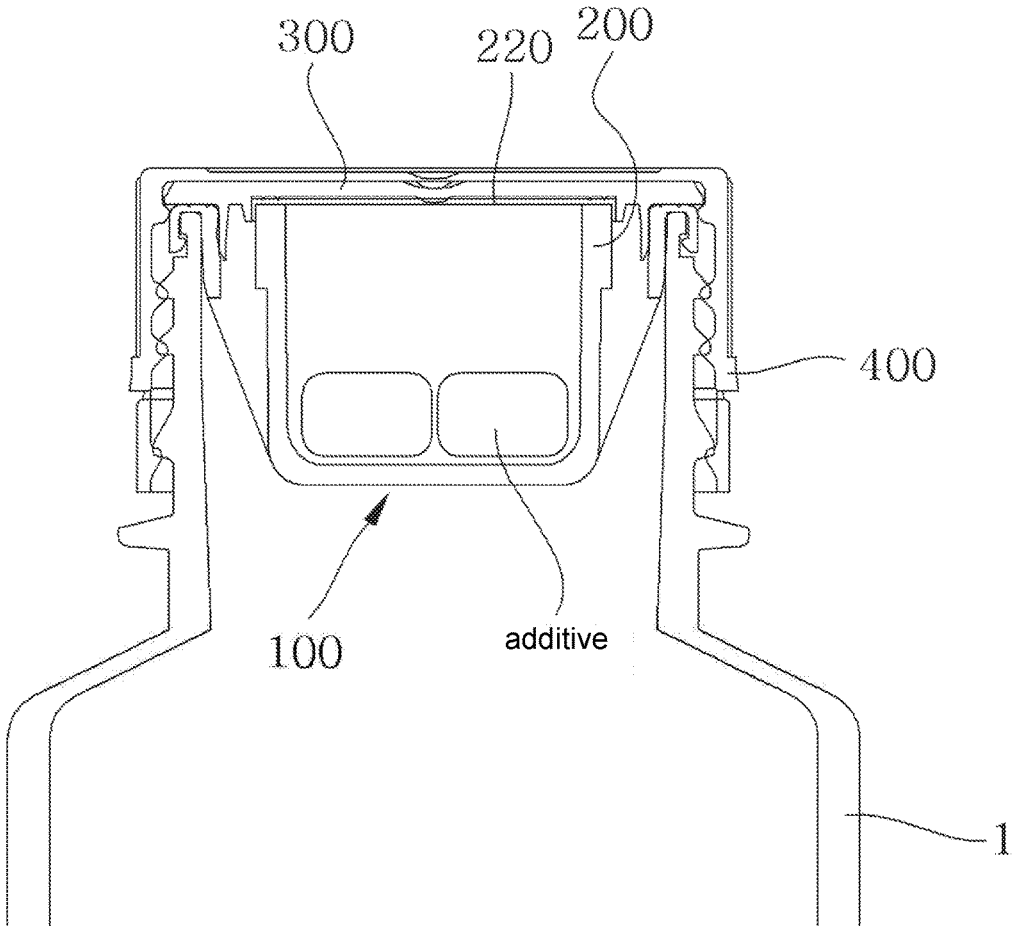
FIG. 9 is a cross-sectional view of the assembly of FIG. 8.

Another embodiment of the present invention as shown in FIG. 8 and FIG. 9 is configured to comprise, an inner cap 100 having an insertion pipe 120 configured to be fitted onto an inlet 2 of a receptacle 1 with a locking hook, a discharge gate 140 connected to the insertion pipe 120 with a small-diameter pipe 145 and formed so that contents in the receptacle is discharged at the small-diameter pipe 145, and a container 200 which is installed at a bottom and has an open upper part to hold additives therein;

a heat-resistant sealing plate 220 configured to heat-seal the upper wall of the container 200;

a fitting ring 310 that fits the sealing plate 220 to a corresponding part for coupling the heat-resistant sealing plate 220, a protruding step 320 which is fitted at an upper end of an inner side wall 401 of an outer cap 400, and a sealing plate holder 300 having a sealing dam 340 protruding downwards to seal the inner circumference part of the insertion pipe 120; and a sealing plate holder fixing step 420, configured to fit and couple the sealing plate holder 300 and formed on an inner part of the side wall 401, and the outer cap 400 is configured to separate the sealing plate holder 300 as the receptacle is opened.

The fitting ring 310 is formed to have a height that may temporarily fix a length of a handle 222 of the sealing plate 220 and an upper end of an outside part of the container 200.

The small-diameter pipe 145 which supports the insertion pipe 120 and container 200 to form the discharge gate 140 is configured to have a diameter that becomes smaller from a lower end of the insertion pipe 120 towards a lower end of a side wall of the container 200.

Other than the sealing plate 220 being fitted to a fitting ring 210 having a smaller diameter than that of the sealing plate holder 300, and a sealing dam 340 sealing the insertion pipe 120 of the container outside the fitting ring 310 is formed to seal only the inlet of the container 200, the function of operation of the structure of FIGS. 8 and 9 is the same as those of FIGS. 1 to 3, and thus detailed description thereof is omitted.

Although the present invention been described with reference to the preferred embodiments, it is intended to aid in the understanding of the technical content of the present invention, and the technical scope of the invention is not intended to be limited thereto.

That is, it would be obvious to those skilled in the art that various changes and modifications can be made to the invention without departing from the technical gist of the present invention, and such changes and modifications are within the technical scope of the present invention in view of the interpretation of the claims.

REFERENCE NUMBERS

1: receptacle
2: inlet
3. outer hook
3': inner hook
4: outer groove
4': inner groove
100: inner cap
110, 110': locking hook
111: horizontal part
112: vertical part
113, 113' hook
120: insertion pipe
140: discharge gate
145: small-diameter pipe
200: container
210: bridge
220: sealing plate
222: handle
300: sealing plate holder
310: fitting hole
320: protruding step
330, 331: presser protrusion
340: sealing dam
400: outer cap
410: skirt
412: parting wall
420: sealing plate holder fixing step

The invention claimed is:

1. A heat-resistant receptacle cap, comprising:

an inner cap, having a first diameter configured to be fitted onto an inlet of a receptacle with a locking hook, a discharge gate connected to the first diameter by a second diameter at a lower base of the inner cap and formed so that contents in the receptacle are discharged at the second diameter, and a container installed at a bottom of the second diameter and has an open upper part to hold additives therein, wherein the second diameter is smaller than the first diameter;

a heat-resistant membrane seal, configured to heat-seal the first diameter and an upper wall of the container;

a membrane seal holder, having a fitting ring that fits the heat-resistant membrane seal to a corresponding part for coupling the membrane seal; and an outer cap, having a membrane seal holder fixing step that is formed on a side wall and configured to separate the membrane seal holder as the receptacle is opened, wherein the membrane seal holder is fitted at an upper end of an inner side wall of the outer cap, wherein the locking hook is configured to have a horizontal part bent toward an outside of the first diameter and a vertical part that bends downward from an outside of the horizontal part and forms a hook at a lower end of an inner side thereof, wherein the hook formed by the vertical part is configured to be coupled to an outer groove at an outside of an upper end of the inlet of the receptacle, and wherein an outer hook protrudes from the upper end of the inlet due to the outer groove.

2. The heat-resistant receptacle cap of claim 1, wherein the membrane seal holder is coupled to the membrane seal holder fixing step of the outer cap and is integrally formed with the outer cap.

* * * * *